US009790054B2

(12) United States Patent
Alasentie

(10) Patent No.: US 9,790,054 B2
(45) Date of Patent: Oct. 17, 2017

(54) COMPENSATING ROPE FOR AN ELEVATOR

(71) Applicant: KONE CORPORATION, Helsinki (FI)

(72) Inventor: Pentti Alasentie, Espoo (FI)

(73) Assignee: KONE CORPORATION, Helsinki (FI)

( * ) Notice: Subject to any disclaimer, the term of this patent is extended or adjusted under 35 U.S.C. 154(b) by 314 days.

(21) Appl. No.: 13/662,259

(22) Filed: Oct. 26, 2012

(65) Prior Publication Data

US 2013/0048432 A1 Feb. 28, 2013

Related U.S. Application Data

(63) Continuation of application No. PCT/FI2011/050364, filed on Apr. 21, 2011.

(30) Foreign Application Priority Data

Apr. 30, 2010 (FI) ..... 20100187

(51) Int. Cl.
*B66B 7/06* (2006.01)
*B66B 11/08* (2006.01)
(Continued)

(52) U.S. Cl.
CPC ..... *B66B 7/062* (2013.01); *B66B 7/068* (2013.01); *D07B 1/22* (2013.01);
(Continued)

(58) Field of Classification Search
CPC ..... B66B 7/068; B66B 7/062
(Continued)

(56) References Cited

U.S. PATENT DOCUMENTS 1,625,083 A * 4/1927 Hymans ..... B66B 7/068 187/404
4,716,989 A * 1/1988 Coleman et al. ..... 187/411
(Continued)

FOREIGN PATENT DOCUMENTS

CN 1585721 A 2/2005
CN 101977834 A 2/2011
(Continued)

OTHER PUBLICATIONS

Chinese Office Action dated Aug. 13, 2014 issued in Chinese Patent Application No. 2011-80029299.8, in English language.
(Continued)

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

Elevator, which includes at least an elevator car and a device for moving the elevator car, preferably along guide rails, and a counterweight, and one or more ropes, which rope connects the elevator car and the counterweight and is separate from the supporting function and passes around a diverting pulley mounted on the bottom end of the elevator hoistway. The rope comprises a power transmission part or a plurality of power transmission parts, for transmitting power in the longitudinal direction of the rope, which power transmission part is essentially fully of non-metallic material.

12 Claims, 2 Drawing Sheets

Figure 1:
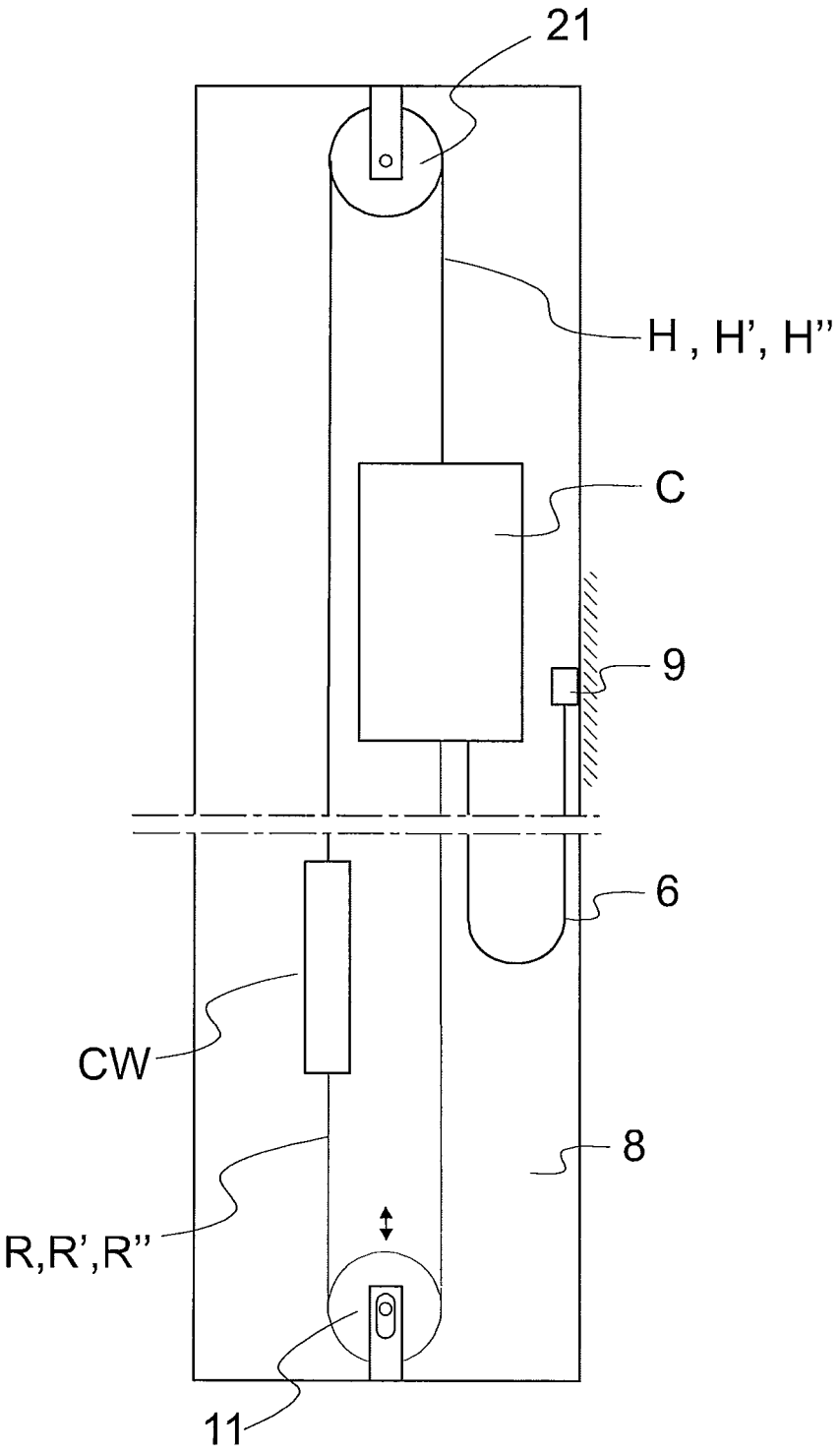

(51) Int. Cl.
*B66B 7/10* (2006.01)
*D07B 1/22* (2006.01)

(52) U.S. Cl.
CPC ..... *D07B 2201/2016* (2013.01); *D07B 2201/2046* (2013.01); *D07B 2205/205* (2013.01); *D07B 2205/301* (2013.01); *D07B 2205/3007* (2013.01); *D07B 2501/2007* (2013.01)

(58) Field of Classification Search
USPC ..... 187/413, 264, 404
See application file for complete search history.

(56) References Cited

U.S. PATENT DOCUMENTS

| | | | | |
|---|---|---|---|---|
| 5,788,018 | A * | 8/1998 | Mendelsohn | B66B 11/08 187/266 |
| 6,364,063 | B1 * | 4/2002 | Aulanko et al. | 187/266 |
| 2002/0092285 | A1 | 7/2002 | Aulanko et al. | |
| 2003/0121729 | A1 * | 7/2003 | Heinz et al. | 187/254 |
| 2003/0155185 | A1 * | 8/2003 | Nomura | B66B 11/009 187/266 |
| 2007/0221452 | A1 * | 9/2007 | Aguirre et al. | 187/373 |
| 2008/0223664 | A1 * | 9/2008 | Johansson | B66B 7/06 187/254 |

FOREIGN PATENT DOCUMENTS

| | | | | |
|---|---|---|---|---|
| EP | 0 100 583 | A2 | 2/1984 | |
| JP | H0891734 | A | 4/1996 | |
| JP | 2002-128420 | A | 5/2002 | |
| JP | 2002-173280 | A | 6/2002 | |
| JP | 2003-104665 | A | 4/2003 | |
| JP | 2011-509899 | A | 3/2011 | |
| WO | WO 98/29327 | A1 | 7/1998 | |
| WO | WO 2009026730 | A1 * | 3/2009 | D07B 1/16 |
| WO | WO 2009/090299 | A1 | 7/2009 | |

OTHER PUBLICATIONS

Japanese Office Action dated Sep. 29, 2014 issued in Japanese Patent Application No. 2013-506693.

* cited by examiner

COMPENSATING ROPE FOR AN ELEVATOR

CROSS REFERENCE TO RELATED APPLICATIONS

This application is a Bypass Continuation of PCT International Application No. PCT/FI2011/050364 filed on Apr. 21, 2011, which claims priority under 35 U.S.C §119(a) to patent application Ser. No. 20100187 filed in Finland on Apr. 30, 2010, all of which are hereby expressly incorporated by reference into the present application.

FIELD OF THE INVENTION

The object of the invention is an elevator, preferably an elevator applicable to moving people.

BACKGROUND OF THE INVENTION

In prior-art elevators, lock-down of the elevator car and of the counterweight is arranged with a metallic compensating rope or chain connecting the elevator car and counterweight, which rope or chain passes around a diverting pulley mounted on the bottom of the elevator hoistway. Arranged this way the rope prevents continuation of the movement of the counterweight in a braking situation of the elevator car. The rope delivers this lock-down function and also simultaneously a compensating function of the masses of the hoisting ropes of the elevator, i.e. compensates an imbalance state of the hoisting ropes caused by a change in the positions of the elevator car and counterweight. A problem in this solution has been that acceleration of a rope dimensioned for compensation purposes along with the acceleration of the elevator car consumes a large amount of energy owing to the large mass of the rope. Correspondingly, a problem has been the laborious braking of the elevator car, because deceleration must be achieved, in addition to the elevator car, in the heavy compensating roping at the same time. All in all, the moving masses have been large, which has been reflected in the dimensioning of numerous other parts of the elevator, e.g. in the dimensioning of guide rails and safety gears. Additionally, elevators of a low travel height that do not have compensating roping also exist. In these, a lock-down function can have been completely omitted. On the other hand, it has also been proposed that the function be arranged by including in the counterweight a brake that is activated in a gripping situation.

AIM OF THE INVENTION

The aim of the invention is to produce an elevator that has a better lock-down arrangement than before. The aim of the invention is to eliminate the aforementioned drawbacks, among others, of prior-art solutions. The aim of the invention is further to produce one or more of the following advantages, among others:

- A safe lock-down function is achieved without producing a large mass to be moved.
- An energy-efficient elevator is achieved.
- A space-efficient elevator is achieved, the rope of which is light and small in terms of its bending radius.
- An elevator is achieved, the mass of the parts of which that move along with the car is lower than before.
- An elevator is achieved, the creeping of the rope of which is minor and the repair work caused by creeping decreases.

- An elevator is achieved, the lock-down rope of which is rigid in the longitudinal direction, but is light and inexpensive.

SUMMARY OF THE INVENTION

The invention is based on the concept that if the rope of an elevator, said rope connecting the elevator car and the counterweight, being separate from the supporting function and passing around a diverting pulley mounted on the bottom end of the elevator hoistway, is formed to be such that its longitudinal power transmission capability is based on non-metallic material, preferably non-metallic fibers, the rope can be lightened and as a result of the lightness the energy efficiency of the elevator improves. More particularly the lock-down function of an elevator can be implemented exerting only a minor increase in the mass moving along with the elevator car. Thus, by forming the rope in a specified way considerable service-life savings can be achieved although the manufacturing costs of the elevator rise when inexpensive metal is surprisingly replaced with more expensive material.

In a basic embodiment of the concept according to the invention the elevator comprises at least an elevator car and means for moving the elevator car, preferably along guide rails, and a counterweight, and one or more ropes, which rope connects the elevator car and the counterweight and is separate from the supporting function and passes around a diverting pulley mounted on the bottom end of the elevator hoistway. The rope comprises a power transmission part or a plurality of power transmission parts, for transmitting power in the longitudinal direction of the rope, which power transmission part is essentially fully of non-metallic material. In this way the aforementioned advantages are achieved.

In a more refined embodiment of the concept according to the invention the elevator comprises a cable in the elevator hoistway, which cable hangs supported by the elevator car and the building, the first end of which cable is fixed to the elevator car and the second end of which cable is fixed to a fixed structure of the building. Compensating the imbalance of the hoisting ropes that changes as a function of car position can thus be arranged by means of a cable and the compensating effect of the lock-down arrangement can be kept small. Reducing the amount of the mass hanging from the counterweight reduces the overall need for compensation.

In a more refined embodiment of the concept according to the invention the rope is arranged to transmit the longitudinal force of the rope between the elevator car and the counterweight with the aforementioned power transmission part, more particularly for slowing down the upward movement of the counterweight in emergency braking of the downward movement of the elevator car. In this way a safe lock-down function that stops the movement of the counterweight can be achieved.

In a more refined embodiment of the concept according to the invention the aforementioned cable is a data transmission cable and/or an electricity transmission cable.

In a more refined embodiment of the concept according to the invention the rope passes around the aforementioned diverting pulley, bending at the point of the diverting pulley around an axis that is in the width direction of the rope, and the width of the rope is greater than the thickness. One advantage, among others, is that the bending radius of the rope can be reduced without losing supporting surface area. As a consequence, the rope can be manufactured from rigid material, the elongation properties of which would otherwise prevent an advantageous bending radius.

In a more refined embodiment of the concept according to the invention the means for moving the elevator car comprise hoisting roping that moves the elevator car and the counterweight, which roping comprises a plurality of ropes (H,H',H"), each of which comprises a power transmission part (5) or a plurality of power transmission parts (5), for transmitting force in the longitudinal direction of the rope, which power transmission part (5) is essentially fully of non-metallic material.

In a more refined embodiment of the concept according to the invention essentially all the power transmission parts (2) of the rope (R,R',R"), and preferably also essentially all the power transmission parts (5) of the rope (H,H',H"), for transmitting force in the longitudinal direction of the rope are essentially fully of non-metallic material. In this way the whole longitudinal power transmission of the rope can be arranged with light material alone.

In a more refined embodiment of the concept according to the invention each power transmission part (2) of the rope (R,R',R"), and preferably also each power transmission part (5) of the rope (H,H',H"), is of a material which comprises non-metallic fibers essentially in the longitudinal direction of the rope. In this way the whole longitudinal power transmission of the rope can be arranged to be based on non-metallic fibers. The power transmission can thus be arranged to be light, using light fibers.

In a more refined embodiment of the concept according to the invention the material of the aforementioned power transmission part (2) and preferably also of the power transmission part (5) is a composite material, which comprises non-metallic fibers as reinforcing fibers in a polymer matrix.

In a more refined embodiment of the concept according to the invention the aforementioned non-metallic fibers of the part 2 are carbon fibers. Thus the elevator is fireproof and energy-efficient.

In a more refined embodiment of the concept according to the invention the aforementioned non-metallic fibers of the part 2 are glass fibers. Thus the elevator is fireproof, energy-efficient and inexpensive, but nevertheless the rope is rigid.

In a more refined embodiment of the concept according to the invention the aforementioned non-metallic fibers of the part 2 are aramid fibers. Thus the elevator is inexpensive, safe and energy-efficient, but nevertheless the rope is rigid.

In a more refined embodiment of the concept according to the invention the aforementioned non-metallic fibers are of a first material, preferably carbon fibers, in the rope of the hoisting roping and of a second material, preferably glass fibers, in the rope passing around the diverting pulley mounted on the bottom end of the elevator hoistway. In this way the masses of the ropings can be simply fitted to be suitable. The aforementioned first material is preferably lighter than the aforementioned second material. The safety factor of the supporting function must generally be considerably larger than that of the lock-down rope, so that the total strength of the supporting roping must be greater than that of the lock-down roping. In this way sufficient strength is obtained in the lock-down roping with a smaller amount of rope than in the supporting roping. In this case the material of the power transmission part of the lock-down roping can be heavier and less of it is needed than for the supporting roping. As a consequence of this the total cross-sectional area of preferably all the power transmission parts 2 of the hoisting roping is greater than the total cross-sectional area of all the power transmission parts 5 of the roping passing around the diverting pulley 11.

In a more refined embodiment of the concept according to the invention the aforementioned power transmission part (2) or a plurality of power transmission parts (2) covers most, preferably 60% or over, more preferably 65% or over, more preferably 70% or over, more preferably 75% or over, most preferably 80% or over, most preferably 85% or over, of the width of the rope. In this way at least most of the width of the rope will be effectively utilized and the rope can be formed to be light and thin in the bending direction for reducing the bending resistance.

In a more refined embodiment of the concept according to the invention the aforementioned plurality of power transmission parts (2, 5) is formed from a plurality of parallel power transmission parts (2, 5). In this way the bending radius of the rope can be reduced.

In a more refined embodiment of the concept according to the invention the width/thickness of the rope (R,R',R",H,H',H") is at least 2 or more, preferably at least 4, even more preferably at least 5 or more, yet even more preferably at least 6, yet even more preferably at least 7 or more, yet even more preferably at least 8 or more, most preferably of all more than 10. In this way good power transmission capability is achieved with a small bending radius. This can be implemented preferably with a composite material presented in this patent application, which material has a very advantageously large width/thickness ratio owing to its rigidity.

In a more refined embodiment of the concept according to the invention the aforementioned power transmission part (2) or a plurality of power transmission parts (2) covers over 40% of the surface area of the cross-section of the rope (R,R',R"), preferably 50% or over, even more preferably 60% or over, even more preferably 65% or over. In this way a large part of the cross-sectional area of the rope can be formed to be supporting. This can be implemented particularly well with the composite presented in this patent application.

In a more refined embodiment of the concept according to the invention the width of the aforementioned power transmission part (2) is greater than the thickness, preferably such that the width/thickness of the aforementioned power transmission part (2) is at least 2 or more, preferably at least 3 or more, even more preferably at least 4 or more, yet even more preferably at least 5, most preferably of all more than 5. In this way a wide rope can be formed simply and to be thin.

In a more refined embodiment of the concept according to the invention the rope R,R',R" is not arranged to transfer the power needed for moving during normal operation to the elevator car or to the counterweight. The rope can thus be formed to be of light structure, primarily for the lock-down function.

In a more refined embodiment of the concept according to the invention the means for moving the elevator car comprise hoisting roping that moves the elevator car and the counterweight, which hoisting roping comprises a plurality of ropes, each of which comprises a power transmission part (5) or a plurality of power transmission parts (5), for transmitting force in the longitudinal direction of the rope, which power transmission part (5) is of metallic material.

In a more refined embodiment of the concept according to the invention the aforementioned diverting pulley 11 is supported in its position such that it is able to move in the vertical direction at most by the amount of a certain margin of movement, which aforementioned movement is preferably prevented when the speed of the aforementioned movement exceeds a certain limit. In this way it can reliably produce vertical support force for the rope loop passing around the diverting pulley, e.g. for preventing its free rise when a lock-down function is needed.

In a more refined embodiment of the concept according to the invention the cable compensates, at least to the extent of 80 percent, preferably essentially completely, the imbalance of the hoisting ropes that changes as a function of car position. In this way the compensation can be implemented independently of the lock-down. The solution is safe and allows formation of the lock-down rope to be light without requiring a certain mass from the hoisting ropes.

In a more refined embodiment of the concept according to the invention the individual reinforcing fibers are evenly distributed into the aforementioned matrix. Thus the composite part of the power transmission part, which composite part is even in its material properties and has a long life, is effectively reinforced with fibers.

In a more refined embodiment of the concept according to the invention the aforementioned reinforcing fibers are continuous fibers in the longitudinal direction of the rope, which fibers preferably continue for essentially the distance of the whole length of the rope. The structure thus formed is rigid and easy to form.

In a more refined embodiment of the concept according to the invention the individual reinforcing fibers are bound together into a uniform power transmission part with the aforementioned polymer matrix, preferably in the manufacturing phase by embedding the reinforcing fibers into the material of the polymer matrix. Thus the structure of the power transmission part is uniform.

In a more refined embodiment of the concept according to the invention the fibers, preferably essentially all the fibers of the power transmission part, are essentially uninterlaced in relation to each other. In this way an advantage, among others, of the straight fibers longitudinal to the rope is the rigid behavior and small relative movement/internal wear of the power transmission part formed by them. In this way creep is minor and a rope that can be formed to be light is also able to quickly stop a counterweight endeavoring to continue its movement.

In a more refined embodiment of the concept according to the invention the polymer matrix is of a non-elastomer. Thus the matrix essentially supports the reinforcing fibers.

In a more refined embodiment of the concept according to the invention the module of elasticity of the polymer matrix is over 2 GPa, most preferably over 2.5 GPa, and yet more preferably in the range 2.5-10 GPa, most preferably of all in the range 2.5-3.5 GPa. In this way a structure is achieved wherein the matrix essentially supports the reinforcing fibers. One advantage, among others, is a longer service life and the enablement of smaller bending radiuses.

In a more refined embodiment of the concept according to the invention the polymer matrix comprises epoxy, polyester, phenolic plastic or vinyl ester. In this way a structure is achieved wherein the matrix essentially supports the reinforcing fibers. One advantage, among others, is a longer service life and the enablement of smaller bending radiuses.

In a more refined embodiment of the concept according to the invention over 50% of the surface area of the cross-section of the power transmission part is of the aforementioned reinforcing fiber, preferably such that 50%-80% is of the aforementioned reinforcing fiber, more preferably such that 55%-70% is of the aforementioned reinforcing fiber. Essentially all the remaining surface area is of polymer matrix. Most preferably such that approx. 60% of the surface area is of reinforcing fiber and approx. 40% is of matrix material. With this advantageous strength properties are achieved while at the same time the amount of matrix material is however sufficient to surround the fibers it binds into one.

In a more refined embodiment of the concept according to the invention each aforementioned power transmission part is surrounded with a polymer layer, which is preferably of elastomer, most preferably of high-friction elastomer such as for instance polyurethane, which layer forms the surface of the rope. In this way the power transmission part(s) is/are protected from wear.

In a more refined embodiment of the concept according to the invention the power transmission part is composed of the aforementioned polymer matrix, reinforcing fibers bound to each other by the polymer matrix, and also possibly a coating around the fibers, and also possibly additives mixed into the polymer matrix.

In a more refined embodiment of the concept according to the invention the rope does not comprise such a quantity of metal wires that together they would form an essential part of the longitudinal power transmission capability of the rope. In this way essentially the whole longitudinal power transmission of the rope can be arranged with a non-metallic material alone.

Preferably the density of the aforementioned non-metallic fibers is less than 4000 kg/m3, and the strength is over 1500 N/mm2, more preferably so that the density of the aforementioned fibers is less than 4000 kg/m3, and the strength is over 2500 N/mm2, most preferably so that the density of the aforementioned fibers is less than 3000 kg/m3, and the strength is over 3000 N/mm2. If the ropes comprise different materials, both the first and the second material can be selected with these criteria.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. Each embodiment can also singly and separately from the other embodiments form a separate invention.

LIST OF FIGURES

In the following, the invention will be described in detail by the aid of some examples of its embodiments with reference to the attached drawings, wherein FIG. 1 presents by way of reference an elevator according to the invention.

Figure 2A:
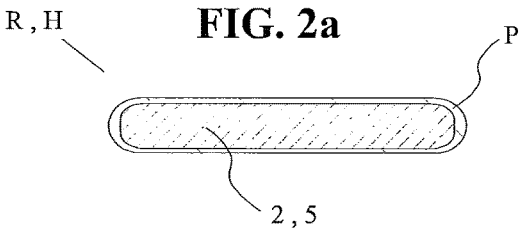
Figure 2B:
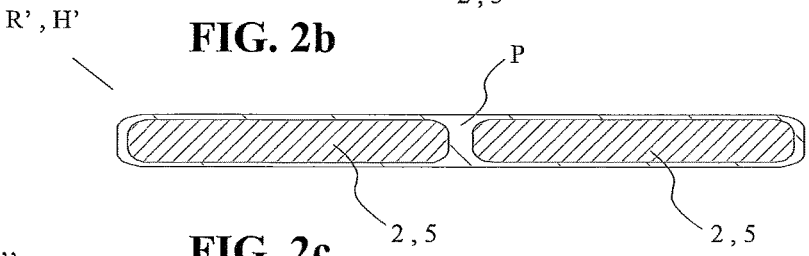
Figure 2C:
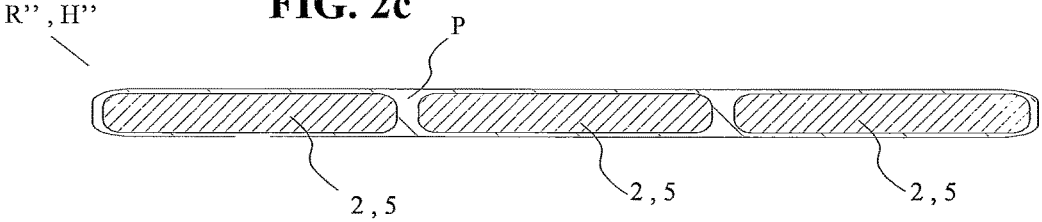

FIGS. 2*a*-2*c* present some preferred cross-sections of the rope of an elevator according to the invention.

Figure 3:
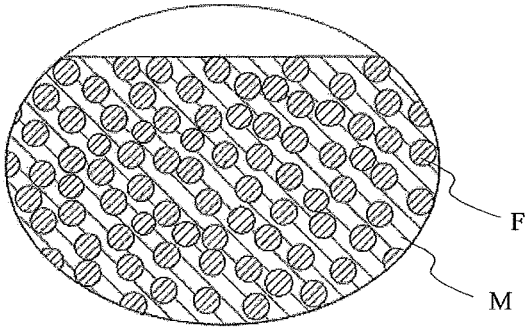

FIG. 3 diagrammatically presents a magnified detail of a cross-section of a rope of an elevator according to the invention.

DETAILED DESCRIPTION OF THE INVENTION

FIG. 1 presents an elevator according to the invention, which elevator comprises an elevator car C and means for moving the elevator car, e.g. along guide rails, which means comprise hoisting roping that supports and moves the elevator car C and counterweight CW, which hoisting roping comprises a plurality of ropes H supporting the elevator car. The ropes H can be moved, for instance, with a motor-driven traction sheave. A diverting pulley 21, for example, can function as a traction sheave. Furthermore the elevator comprises one or more ropes R,R',R", which rope connects the elevator car and the counterweight and is separate from the supporting function (i.e. does not support the car or the counterweight) and passes around a diverting pulley 11 mounted on the bottom end of the elevator hoistway. The rope R,R',R" hangs supported by the counterweight and the elevator car. The diverting pulley 11 is supported in its position and keeps the rope taut. The rope R,R',R" comprises a power transmission part 2 or a plurality of power transmission parts 2, for transmitting force in the longitudinal direction of the rope, which power transmission part 2 is essentially fully of non-metallic material. Thus the rope can be kept light because its power transmission capability in the longitudinal direction can be formed to be based on non-metallic light fibers. The rope (R,R',R") is arranged to transmit the longitudinal force of the rope between the elevator car C and the counterweight CW with the aforementioned power transmission part 2, more particularly for slowing down the upward movement of the counterweight CW in emergency braking of the downward movement of the elevator car C. In this way continuation of the movement of the counterweight can be prevented e.g. in a situation in which the speed of the elevator car is decelerated quickly, with an acceleration of even 1 G or faster. When the rope R,R',R" is very light, compensation of the mass of the hoisting ropes is preferably arranged as presented in FIG. 1 by means of a cable 6 in the elevator hoistway 8, which cable hangs supported by the elevator car C and the building, the first end of which cable 6 is fixed to the elevator car C and the second end of which cable is fixed to a fixed structure 9 of the building. This cable can thus be arranged to at least essentially compensate the imbalance between parts of the hoisting roping on different sides of the traction sheave 21, which imbalance changes as a function of car position. Since the cable is suspended in a specified manner, the length of the section of it that is supported by the elevator car, and thus the downward-pulling force exerted on the elevator car, changes as a function of car position. The aforementioned cable 6 is preferably a data transmission cable and/or an electricity transmission cable, in which case a separate method is not needed for the transmission.

In the solution according to the invention the aforementioned power transmission part(s) 2 of a non-metallic material is/are preferably of a material, which comprises non-metallic fibers at least essentially longitudinal to the rope. More particularly, the aforementioned non-metallic fibers are carbon fibers, glass fibers or aramid fibers, which are all light fibers. The material of the power transmission part is in this case most preferably formed to be a composite material, which comprises the aforementioned non-metallic fibers as reinforcing fibers in a polymer matrix. Thus the power transmission part 2 is light, rigid in the longitudinal direction and when it is belt-shaped it can, however, be bent with a small bending radius. Especially preferably the fibers are carbon fibers or glass fibers, the advantageous properties of which fibers can be seen in the table below. They possess good strength properties and rigidity properties and at the same time they still tolerate very high temperatures, which is important in elevators because poor heat tolerance of the hoisting ropes might cause damage or even ignition of the hoisting ropes, which is a safety risk. Good thermal conductivity also assists the onward transfer of heat due to friction, among other things, and thus reduces the accumulation of heat in the parts of the rope. More particularly the properties of carbon fiber are advantageous in elevator use.

| | | Glass fiber | Carbon fiber | Aramid fiber |
|---|---|---|---|---|
| Density | kg/m3 | 2540 | 1820 | 1450 |
| Strength | N/mm2 | 3600 | 4500 | 3620 |
| Rigidity | N/mm2 | 75000 | 200000-600000 | 75000 . . . 120000 |
| Softening temperature | deg/C. | 850 | >2000 | 450 . . . 500, carbonizes |
| Thermal conductivity | W/mK | 0.8 | 105 | 0.05 |

The rope R,R',R" of FIG. 1 is preferably according to one presented in FIGS. 2*a*-2*c*. As presented in the figures, the rope R,R',R" of the elevator according to the invention is most preferably belt-shaped. Its width/thickness ratio is preferably at least 2 or more, preferably at least 4, even more preferably at least 5 or more, yet even more preferably at least 6, yet even more preferably at least 7 or more, yet even more preferably at least 8 or more, most preferably of all more than 10. In this way a large cross-sectional area for the rope is achieved, the bending capacity of the thickness direction of which is good around the axis of the width direction also with rigid materials of the power transmission part. Additionally, preferably the aforementioned power transmission part 2 or a plurality of power transmission parts 2 together cover most of the width of the cross-section of the rope for essentially the whole length of the rope. Preferably the power transmission part(s) 2 thus cover(s) 60% or over, more preferably 65% or over, more preferably 70% or over, more preferably 75% or over, most preferably 80% or over, most preferably 85% or over, of the width of the cross-section of the rope. Thus the supporting capacity of the rope with respect to its total lateral dimensions is good, and the rope does not need to be formed to be thick. This can be simply implemented with any of the aforementioned materials, with which the thinness of the rope is particularly advantageous from the standpoint of, among other things, service life and bending rigidity. When the rope comprises a plurality of power transmission parts 2, the aforementioned plurality of power transmission parts 2 is formed from a plurality of power transmission parts 2 that are parallel in the width direction of the rope and are on essentially the same plane. Thus the resistance to bending in their thickness direction is small.

The power transmission part 2 or the aforementioned plurality of power transmission parts 2 of the rope R,R',R" of the elevator according to the invention is/are preferably fully of non-metallic material. Thus the rope is light. (The power transmission parts could, however, if necessary be formed to comprise individual metal wires for another purpose than force transmission in the longitudinal direction, for instance in a condition monitoring purpose, but such that their aggregated power transmission capability does not form an essential part of the power transmission capability of the rope.) The rope can comprise one power transmission part of the aforementioned type, or a plurality of them, in which case this plurality of power transmission parts 2 is formed from a plurality of parallel power transmission parts 2. This is illustrated in FIGS. 2*b*-2*c*. The aforementioned power transmission part 2 singly or a plurality of power transmission parts 2 together covers over 40% of the surface area of the cross-section of the rope R,R',R", preferably 50% or over, even more preferably 60% or over, even more preferably 65% or over. In this way a large cross-sectional area is achieved for the power transmission part/parts of the rope, and an advantageous capability for transferring forces. The rigidity of the rope makes it possible that the tightening of the rope R,R',R" does not require special arrangements, e.g. the tightening margin does not need to be large and it does not need to be re-adjusted e.g. by transferring the support point of the tensioning weight.

The width of the aforementioned power transmission part 2 is greater than the thickness. In this case preferably such that the width/thickness of the power transmission part 2 is at least 2 or more, preferably at least 3 or more, even more preferably at least 4 or more, yet even more preferably at least 5, most preferably of all more than 5. In this way a large cross-sectional area for the power transmission part/parts is achieved, the bending capacity of the thickness direction of which is good around the axis of the width direction also with rigid materials of the power transmission part. The aforementioned power transmission part 2 or a plurality of power transmission parts 2 is surrounded with a coating p in the manner presented in FIGS. 2*a*-2*c*, which is preferably of polymer, most preferably of polyurethane. Alternatively one power transmission part 2 could form a rope also on its own, with or without a polymer layer p.

For facilitating the formation of the power transmission part and for achieving the constant properties in the longitudinal direction it is preferred that the structure of the power transmission part 2 continues essentially the same for the whole length of the rope. For the same reasons, the structure of the rope continues preferably essentially the same for the whole length of the rope.

The elevator preferably comprises a type of hoisting roping, each rope H of which comprises a power transmission part or a plurality of power transmission parts 2, for transmitting force in the longitudinal direction of the rope, which power transmission part 2 is essentially fully of non-metallic material. For keeping the hoisting roping light, essentially all the power transmission parts 2 of each rope H for transmitting force in the longitudinal direction of the rope are essentially fully of non-metallic material. In terms of its reinforcing fibers, the hoisting roping is preferably of carbon fiber. In respect of its other structures, each rope H of the hoisting roping is preferably according to one presented in FIGS. 2*a*-2*c*.

The aforementioned power transmission part 2 is more precisely, in terms of its material, preferably one of the following types. It is a non-metallic composite, which comprises non-metallic reinforcing fibers, preferably carbon fibers, glass fibers or aramid fibers, more preferably carbon fibers or glass fibers in a polymer matrix M. The part 2 with its fibers is longitudinal to the rope, for which reason the rope retains its structure when bending. Individual fibers are thus oriented in essentially the longitudinal direction of the rope. In this case the fibers are aligned with the force when the rope is pulled. The aforementioned reinforcing fibers are bound into a uniform power transmission part with the aforementioned polymer matrix. Thus the aforementioned power transmission part 2 is one solid elongated rod-like piece. The aforementioned reinforcing fibers are preferably long continuous fibers in the longitudinal direction of the rope, which fibers preferably continue for the distance of the whole length of the rope. Preferably as many fibers as possible, most preferably essentially all the fibers of the aforementioned power transmission part are longitudinal to the rope. The reinforcing fibers are in this case preferably essentially uninterlaced in relation to each other. Thus the structure of the power transmission part can be made to continue the same as far as possible in terms of its cross-section for the whole length of the rope. The aforementioned reinforcing fibers are distributed in the aforementioned power transmission part as evenly as possible, so that the power transmission part would be as homogeneous as possible in the transverse direction of the rope. The bending direction of the rope is preferably around an axis that is in the width direction of the rope (up or down in the figure). As presented in FIGS. 2*a*-*c*, each aforementioned power transmission part 2 is surrounded with a polymer layer 1, which is preferably of elastomer, most preferably of high-friction elastomer such as preferably of polyurethane, which layer forms the surface of the rope. An advantage of the structure presented is that the matrix surrounding the reinforcing fibers keeps the interpositioning of the reinforcing fibers essentially unchanged. It equalizes with its slight elasticity the distribution of a force exerted on the fibers, reduces fiber-fiber contacts and internal wear of the rope, thus improving the service life of the rope. The reinforcing fibers can be glass fibers, in which case good electrical insulation and an inexpensive price, among other things, are achieved. Alternatively the reinforcing fibers can be carbon fibers, in which case good tensile rigidity and a light structure and good thermal properties, among other things, are achieved. In this case also the tensile rigidity of the rope is slightly lower, so that traction sheaves of small diameter can be used. The composite matrix, into which the individual fibers are distributed as evenly as possible, is most preferably of epoxy resin, which has good adhesiveness to the reinforcements and which is strong to behave advantageously at least with glass fiber and carbon fiber. Alternatively, e.g. polyester or vinyl ester can be used.

FIG. 3 presents a preferred internal structure for a power transmission part 2. A partial cross-section of the surface structure of the power transmission part (as viewed in the longitudinal direction of the rope) is presented inside the circle in the figure, according to which cross-section the reinforcing fibers of the power transmission parts presented elsewhere in this application are preferably in a polymer matrix. The figure presents how the reinforcing fibers F are essentially evenly distributed in the polymer matrix M, which surrounds the fibers and which is fixed to the fibers. The polymer matrix M fills the areas between individual reinforcing fibers F and binds essentially all the reinforcing fibers F that are inside the matrix M to each other as a uniform solid substance. In this case abrasive movement between the reinforcing fibers F and abrasive movement between the reinforcing fibers F and the matrix M are essentially prevented. A chemical bond exists between, preferably all, the individual reinforcing fibers F and the matrix M, one advantage of which is uniformity of the structure, among other things. To strengthen the chemical bond, there can be, but not necessarily, a coating (not presented) of the actual fibers between the reinforcing fibers and the polymer matrix M. The polymer matrix M is of the kind described elsewhere in this application and can thus comprise additives for fine-tuning the properties of the matrix as an addition to the base polymer. The polymer matrix M is preferably of a hard non-elastomer. The reinforcing fibers being in the polymer matrix means here that in the invention the individual reinforcing fibers are bound to each other with a polymer matrix e.g. in the manufacturing phase by embedding them together in the molten material of the polymer matrix. In this case the gaps of individual reinforcing fibers bound to each other with the polymer matrix comprise the polymer of the matrix. Thus in the invention preferably a large amount of reinforcing fibers bound to each other in the longitudinal direction of the rope are distributed in the polymer matrix. The reinforcing fibers are preferably distributed essentially evenly in the polymer matrix such that the power transmission part is as homogeneous as possible when viewed in the direction of the cross-section of the rope. In other words, the fiber density in the cross-section of the power transmission part does not therefore vary greatly. The reinforcing fibers together with the matrix form a uniform power transmission part, inside which abrasive relative movement does not occur when the rope is bent. The individual reinforcing fibers of the power transmission part are mainly surrounded with polymer matrix, but fiber-fiber contacts can occur in places because controlling the position of the fibers in relation to each other in their simultaneous impregnation with polymer is difficult, and on the other hand, totally perfect elimination of random fiber-fiber contacts is not wholly necessary from the viewpoint of the functioning of the invention. If, however, it is desired to reduce their random occurrence, the individual reinforcing fibers can be pre-coated such that a polymer coating is around them already before the binding of individual reinforcing fibers to each other. In the invention the individual reinforcing fibers of the power transmission part can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the power transmission part such that the gaps of individual reinforcing fibers comprise the polymer of the matrix. Most preferably the majority, preferably essentially all of the gaps of the individual reinforcing fibers in the power transmission part are filled with the polymer of the matrix. The matrix of the power transmission part is most preferably hard in its material properties. A hard matrix helps to support the reinforcing fibers, especially when the rope bends, preventing buckling of the reinforcing fibers of the bent rope, because the hard material supports the fibers. To reduce the bending radius of the rope, among other things, it is therefore preferred that the polymer matrix is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the power transmission part is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix. Most preferably such that approx. 60% of the surface area is of reinforcing fiber and approx. 40% is of matrix material (preferably epoxy). In this way a good longitudinal strength of the rope is achieved. When the power transmission part is of a composite comprising non-metallic reinforcing fibers the aforementioned power transmission part is a uniform, elongated, rigid piece. One advantage, among others, is that it returns to its shape from a bent position to be straight.

In this application, the term power transmission part refers to the part that is elongated in the longitudinal direction of the rope, which part is able to bear a significant part of the load in the longitudinal direction of the rope exerted on the rope in question without breaking, which load comprises e.g. the own mass of the rope and the force required of the rope in question for stopping the counterweight or the elevator car. The aforementioned load causes tension on the power transmission part in the longitudinal direction of the rope, which tension is transmitted onwards for an essentially long distance in the longitudinal direction of the rope inside the power transmission part in question. The power transmission part of the rope R,R'R" does not support the elevator car or its load during normal operation of the elevator. The rope R,R',R" is also preferably not arranged to transfer the power needed for moving during normal operation to the elevator car or to the counterweight.

The aforementioned fibers F are at least essentially longitudinal to the rope, preferably as longitudinal as possible and essentially uninterlaced with each other. The invention could also, however, be applied with braided fibers. Although the rope of the invention is preferably belt-shaped, its internal structure could also be utilized with other cross-sectional shapes of ropes.

It is obvious to the person skilled in the art that the invention is not limited to the embodiments described above, in which the invention is described using examples, but that many adaptations and different embodiments of the invention are possible within the frameworks of the inventive concept defined by the claims presented below. For example, it is obvious that the diverting pulley 11 can be a stationary rotating diverting pulley.

The invention claimed is:

1. An elevator comprising at least an elevator car and a device configured to move the elevator car and a counterweight, and one or more ropes, which one or more ropes connect the elevator car and the counterweight and pass around a diverting pulley mounted on a bottom end of an elevator hoistway, and do not perform a supporting function of supporting and moving the elevator car and the counterweight, wherein each of the one or more ropes comprises a power transmission part or a plurality of power transmission parts, for transmitting power in a longitudinal direction of each of the one or more ropes, wherein each power transmission part is essentially fully of non-metallic material, wherein the device configured to move the elevator car comprises hoisting roping that provides the supporting function of supporting and moving the elevator car and the counterweight, which hoisting roping comprises a plurality of hoisting ropes, each of which comprises a power transmission part or a plurality of power transmission parts, for transmitting force in the longitudinal direction of the hoisting roping, wherein each power transmission part is essentially fully of non-metallic material, wherein a total cross-sectional area of all the power transmission parts of the hoisting roping is greater than a sum of a cross-sectional area of each power transmission part of the one or more ropes passing around the diverting pulley.

2. The elevator according to claim 1, further comprising a cable in the elevator hoistway, which cable hangs supported by the elevator car and a building, a first end of which cable is fixed to the elevator car and a second end of which cable is fixed to a fixed structure of the building.

3. The elevator according to claim 2, wherein the cable is a data transmission cable and/or an electricity transmission cable.

4. The elevator according to claim 2, wherein each of the one or more ropes is arranged to transmit force in the longitudinal direction of the one or more ropes between the elevator car and the counterweight with the power transmission part or the plurality of power transmission parts, for slowing down an upward movement of the counterweight in emergency braking of a downward movement of the elevator car.

5. The elevator according to claim 1, wherein the non-metallic material of each of the power transmission parts of the one or more ropes is a composite material, which comprises non-metallic fibers as reinforcing fibers in a polymer matrix.

6. The elevator according to claim 5, wherein the non-metallic fibers are carbon fibers or glass fibers or aramid fibers.

7. The elevator according to claim 5, wherein a density of the non-metallic fibers is less than 4000kg/m3, and a strength is over 1500 N/mm2.

8. The elevator according to claim 1, wherein the non-metallic material of each of the power transmission parts of the hoisting roping is a first material and the non-metallic material of each of the power transmission parts of the one or more ropes is a second material.

9. The elevator according to claim 8, wherein the first material is lighter than the second material.

10. The elevator according to claim 1, wherein each of the one or more ropes is arranged to transmit force in the longitudinal direction of the one or more ropes between the elevator car and the counterweight with the power transmission part or a the plurality of power transmission parts, for slowing down an upward movement of the counterweight in emergency braking of a downward movement of the elevator car.

11. The elevator according to claim 1, wherein the non-metallic material of each of the power transmission part of the one or more ropes comprises non-metallic fibers which are oriented essentially in the longitudinal direction of each of the one or more ropes.

12. The elevator according to claim 1, wherein each of the one or more ropes passes around the diverting pulley bending at a point of the diverting pulley around an axis that is in a width direction of each of the one or more ropes, and in that the width of each of the one or more rope is greater than a thickness of each of the one of the more ropes.

* * * * *